US005825778A

United States Patent [19]

Hauge

[11] Patent Number: 5,825,778

[45] Date of Patent: Oct. 20, 1998

[54] VSB MODULATOR INPUT INTERFRACE USING SIMPLE STANDARD

[75] Inventor: Raymond C. Hauge, Fox River Grove, Ill.

[73] Assignee: Zenith Electronics Corporation, Glenview, Ill.

[21] Appl. No.: 725,870

[22] Filed: Oct. 4, 1996

[51] Int. Cl.[6] ..... H04R 11/04

[52] U.S. Cl. ..... 370/473; 370/428

[58] Field of Search ..... 370/394, 487, 370/473, 477, 517, 535, 229, 232, 233, 234, 366, 368, 412, 413, 414, 415, 416, 417, 418, 428, 429, 384; 348/7, 385; 455/4.2, 503

[56] References Cited

U.S. PATENT DOCUMENTS 5,596,581 1/1997 Saeifs et al. ..... 370/522

5,610,916 3/1997 Kostreski et al. ..... 370/487

*Primary Examiner*—Dang Ton

[57] ABSTRACT

An interface for coupling 19.39 MHz serial packetized transport data in MPEG form to parallel transport data having a maximum symbol rate of 10.76 megasymbols per second. The incoming data includes filler packets to assure that the input bit rate is always in excess of a nominal bit rate. A serial/parallel decoder generates packetized parallel data which is applied to a packet remover. A buffer of multi packet capacity is periodically read to determine its fullness. Packets are removed as required to maintain the desired input bit rate. The buffer supplies a filler packet inserter that is also operated in accordance with the buffer fullness to assure an optimized output packetized data stream of symbols that does not exceed a maximum symbol rate.

9 Claims, 1 Drawing Sheet

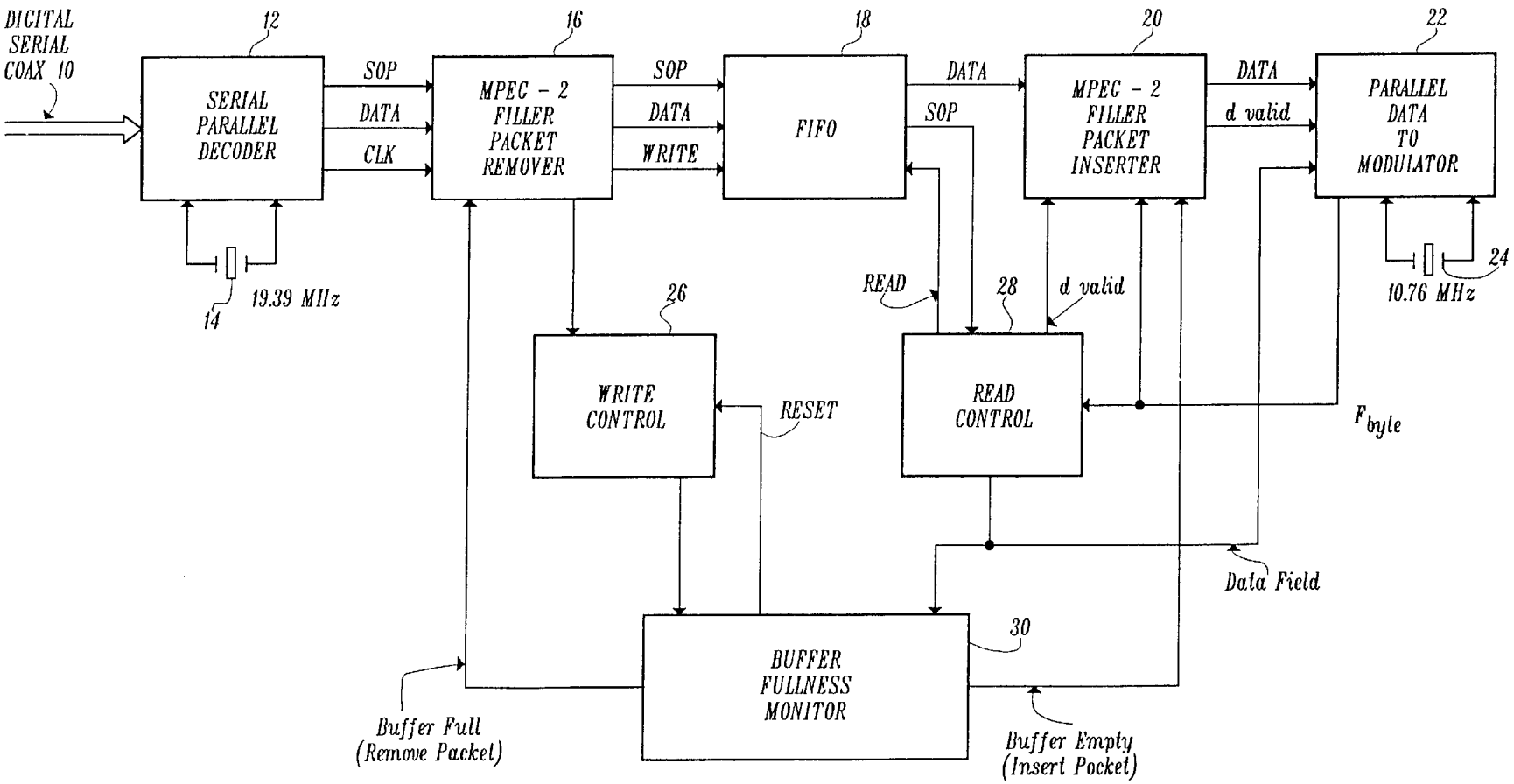
DIGITAL SERIAL COAX 10
SERIAL PARALLEL DECODER
12
19.39 MHz
14
SOP
DATA
CLK
MPEG - 2 FILLER PACKET REMOVER
16
SOP
DATA
WRITE
FIFO
18
DATA
SOP
MPEG - 2 FILLER PACKET INSERTER
20
DATA
d valid
PARALLEL DATA TO MODULATOR
22
10.76 MHz
24
READ CONTROL
28
d valid
READ
WRITE CONTROL
26
RESET
BUFFER FULLNESS MONITOR
30
Buffer Full (Remove Packet)
Buffer Empty (Insert Packet)
Data Field
$F_{byte}$

VSB MODULATOR INPUT INTERFRACE USING SIMPLE STANDARD

BACKGROUND OF THE INVENTION AND PRIOR ART

This invention relates to systems and techniques for interfacing a variety of signal sources to the input of an SMPTE (Society of Motion Picture and Television Engineers) type VSB modulator. The system protocol is MPEG-2 (Motion Picture Experts Group) packetized transport streams of data. The variety of input sources and the relatively high tolerances of their clock frequencies, coupled with the need for relatively close tolerance on the VSB symbol rate of 10.76 megasymbols per second, poses a problem that this invention overcomes.

The data inputs to the various VSB modulators must be closely controlled to maintain the symbol rate. In one arrangement for controlling the data input (described in copending application Ser. No. 08/671,464, entitled MPEG TRANSPORT FOR INDEPENDENTLY CLOCKED TRANSPORT STREAMS and assigned to Zenith Electronics Corporation, which is hereby incorporated by reference), an assumption was made that the input data streams would never exceed the bit or data rate of the multiplexed output transport signal to the modulators. To minimize the cost of buffers in customer set top boxes, filler packets were added, as required, to the output transport stream to maintain the symbol rate. Various prioritization systems may be used to optimize the jitter or delay experienced by the various levels of service, i.e., high speed and low speed services.

The present invention meets the criterion that the input data stream to the VSB modulators not exceed the maximum symbol rate of the multiplexed output transport stream and obviates the cost and difficulty in attempting to maintain close tolerances on the various source transport streams. The SMPTE standard establishes a nominal 19.39 MHz clock frequency for the packetized MPEG-2 data streams. Therefore the actual clock frequencies may vary about the nominal frequency. With temperature controlled crystals and the like, the degree of variation can be minimized, but the cost would still be prohibitive.

OBJECTS OF THE INVENTION

A principal object of the invention is to provide a novel interface for MPEG transport data streams and VSB modulators.

Another object of the invention is to enable an interface between a transport stream and a VSB modulator input that does not require close tolerances.

A further object of the invention is to provide a system for intercoupling a variety of sources operating at a nominal bit rate to an input that requires relatively close bit rate tolerances.

BRIEF DESCRIPTION OF THE DRAWING

These and other objects and advantages of the invention will become apparent upon reading the following description thereof in conjunction with the drawing, the single FIGURE of which depicts an interface constructed in accordance with the invention.

DESCRIPTION OF THE PREFERRED EMBODIMENT

To practice the invention, the various input source signals must augment their transport data streams with filler packets that are regularly inserted in the individual data streams. A filler packet may contain any type of non time dependent packet information, ranging from a null packet to an information packet. The purpose of such packets is to assure that the input transport stream data rate does not fall below the nominal 19.39 MHz bit rate. The number and frequency of the filler packets may be calculated from the bit rate and the variations therein of the various sources. The inclusion of the filler packets enables the interface to meet the criterion established for the input to the various VSB modulators without resorting to expensive crystal controls.

Referring to the drawing, a coaxial cable input 10 is indicated as supplying a digital serial signal to a serial-parallel decoder 12 that is controlled by a crystal 14 of 19.39 MHz frequency. As indicated, the signals are in MPEG-2 form and include a header that has various information such as a sync byte signal, a packet identifier, etc. and filler packets, as discussed. Decoder 12 outputs an SOP (start-of-packet) signal, a data signal and a clock signal to an MPEG-2 filler packet remover block 16.

The outputs of block 16 are applied to a FIFO (first in-first out) buffer with multi packet capacity. The FIFO supplies data to an MPEG-2 filler packet inserter 20 that may take the form disclosed in the copending application mentioned above. The output of block 20 is coupled to a block 22 that is controlled by a 10.76 MHz crystal 24 for generating parallel data for the modulators. This block may also use well known techniques including that disclosed in the copending application above-mentioned.

A write control 26 and a read control 28 are included for supplying information to a buffer fullness monitor 30 that controls the operation of filler packet remover 16 and filler packet inserter 20. The various functions of the blocks will be described in general terms.

The serial-parallel decoder 12 includes a zero crossing detector, that includes a differentiator for clock recovery, and a data slicer. It also includes means for recovering the transport clock of nominal 19.39 MHz frequency, means for recovering the MPEG-2 sync and for creating an SOP signal, and means for accomplishing serial to parallel conversion of the data packets.

The filler packet remover block 16 includes means for reading the packet header so as to identify a filler packet. If the buffer fullness monitor indicates that the buffer is full, it will not write the filler packet to the FIFO. If the buffer is not full, the filler packet will be written to the FIFO.

The write control block 26 counts the number of the SOP that has been entered into the FIFO.

The FIFO 18 stores the SOP for output timing of the packets and has a multi packet capacity.

The filler packet inserter 20, under control of the buffer fullness monitor inserts a filler packet when there is an underflow (shortage of data) condition and generates an SOP signal for the inserted filler packet. Otherwise, it will read in the data from the FIFO.

The read control 28 synchronizes SOP signal timing with a timing generator and establishes the timing and format for an ATV (advanced television) data frame. This includes generation of the 188 byte (per packet) read clocks, creation of 20 null bytes for RS (Reed Solomon) parity, creation of the field sync signal and the creation of 312 data valid signals for each data field.

The buffer fullness monitor 30 compares the write SOP signal count with 312 to determine an underflow or overflow condition and resets the write counter to zero.

What has been described is a novel interface for coupling a plurality of independent sources of nominal bit rate to an input for a VSB modulator that requires a closely controlled symbol rate, without resorting to expensive crystals. It is recognized that numerous changes in the described embodiment of the invention will occur to those skilled in the art without departing from its true spirit and scope. The invention is to be limited only as defined in the claims.

What is claimed is:

1. A method of converting a packetized input transport data stream comprising data symbols transmitted at a nominal bit rate, to optimize a packetized output transport data stream of the data symbols with a bit rate that does not exceed the nominal bit rate comprising:

supplying the packetized input transport data stream, in parallel form to a buffer;

monitoring the fullness of the buffer;

adding filler packets to the input transport data stream to assure an input bit rate in excess of the nominal bit rate; and removing the added filler packets, as required, in response to the buffer fullness monitor to optimize an output bit rate that does not exceed the nominal bit rate.

2. The method of claim 1, further comprising:

supplying the parallel form input transport data stream to a filler packet remover;

supplying the output of the filler packet remover to the buffer; and activating the filler packet remover in response to the buffer fullness monitor.

3. The method of claim 1, further comprising:

developing a packetized parallel data stream of symbols for a modulator; and adding other filler packets, as required, to optimize the packetized parallel data stream at a symbol rate that does not exceed a maximum symbol rate.

4. The method of claim 2, further comprising:

supplying the buffer output signal through a filler packet inserter;

developing a packetized parallel data stream of symbols for a modulator; and activating the other filler packet inserter in response to the buffer fullness monitor to insert filler packets, as required, to produce an optimized packetized parallel data stream having a symbol rate that does not exceed a maximum symbol rate.

5. A method of converting a packetized input transport data stream, comprising data symbols transmitted at a nominal bit rate, to a packetized parallel data stream for a VSB modulator, at a symbol rate that does not exceed a maximum symbol rate, comprising:

adding filler packets to the input transport data stream to assure an input bit rate that is in excess of the nominal bit rate;

supplying the packetized input transport data stream, in parallel form, to a buffer;

monitoring the fullness of the buffer;

removing the added filler packets, as required, in response to the buffer fullness, to optimize an output bit rate that does not exceed the nominal bit rate;

developing a packetized parallel data stream of symbols for the modulator; and adding filler packets, as required, to optimize the packetized parallel data stream at a symbol rate that does not exceed a maximum symbol rate.

6. An interface for converting a packetized input transport data stream in serial form, comprising data symbols transmitted at a nominal bit rate, to an optimized, packetized output transport data stream of the data symbols with a bit rate that does not exceed said nominal bit rate, said input transport data stream including filler packets for assuring an input bit rate that is in excess of said nominal bit rate comprising:

means for converting said packetized input transport data stream to parallel form;

buffer means;

means for supplying said parallel form input transport data stream to said buffer means;

means for monitoring the fullness of said buffer means;

filler packet removal means; and means for operating said filler packet removal means in response to said monitoring means for removing said filler packets, as required, to develop an optimized output bit rate that does not exceed said nominal bit rate.

7. The interface of claim 6, further comprising:

means for developing a packetized parallel data stream of symbols for a modulator from said data in said buffer means;

filler packet inserter means; and means for operating said filler packet inserter means, responsive to said monitoring means, to insert other filler packets, as required, to optimize said packetized parallel data stream at a symbol rate that does not exceed a maximum symbol rate.

8. The interface of claim 7, wherein said nominal bit rate is 19.39 MHz and wherein said maximum symbol rate is 10.76 megasymbols/second.

9. The interface of claim 8, wherein said buffer means is a FIFO of multi packet capacity, and wherein said packetized data streams are MPEG packets of 188 bytes each.

* * * * *

UNITED STATES PATENT AND TRADEMARK OFFICE

CERTIFICATE OF CORRECTION

PATENT NO. : 5,825,778
DATED : October 20, 1998
INVENTOR(S) : Raymond C. Hauge

It is certified that error appears in the above-identified patent and that said Letters Patent is hereby corrected as shown below:

On the title page, item [54] and column 1, line 2, "SIMPLE" should read --SMPTE--

Signed and Sealed this

Sixteenth Day of February, 1999

*Attest:*

*Attesting Officer*

*Acting Commissioner of Patents and Trademarks*